US005765638A

United States Patent [19]

Taylor

[11] Patent Number: 5,765,638

[45] Date of Patent: Jun. 16, 1998

[54] TOOL FOR USE IN RETRIEVING AN ESSENTIALLY CYLINDRICAL OBJECT FROM A WELL BORE

[75] Inventor: Robert Bonner Taylor, College Station, Tex.

[73] Assignee: Houston Engineers, Inc., Houston, Tex.

[21] Appl. No.: 777,149

[22] Filed: Dec. 26, 1996

[51] Int. Cl.[6] ..... E21B 31/18

[52] U.S. Cl. ..... 166/98; 166/115; 166/242.6; 294/86.15

[58] Field of Search ..... 166/98, 115, 187, 166/242.6, 277, 301; 294/86.1, 86.15

[56] References Cited

U.S. PATENT DOCUMENTS 3,872,926 3/1975 Vangils ..... 166/98 X 4,369,977 1/1983 Bishop et al. .

5,249,625 10/1993 Skipper et al. ..... 166/98

OTHER PUBLICATIONS pp. 203 and 204 from the *Composite Catalog* of Oilfield Equipment and Services; 42nd edition, 1996–97; vol. 1; catalog file A thru G; published by World Oil.

*Primary Examiner*—Roger J. Schoeppel

*Attorney, Agent, or Firm*—Vaden, Eickenroht & Thompson, L.L.P.

[57] ABSTRACT

There are disclosed two embodiments of a tool for use in retrieving a cylindrical object which is stuck within a well bore, or, in the event the object cannot be retrieved, releasing therefrom to permit recovery of the tool.

5 Claims, 8 Drawing Sheets

TOOL FOR USE IN RETRIEVING AN ESSENTIALLY CYLINDRICAL OBJECT FROM A WELL BORE

This invention relates generally to improvements in tools for use in retrieving an essentially cylindrical object from a well bore. Typically, these tools are referred to as "overshots" for use in retrieving an object often called a "fish" which is stuck within the bore of an oil or gas well.

One tool of this type, which is manufactured and sold by Bowen Tools, Inc., and known as its Series 150, comprises a hollow body adapted to be connected to a pipe string for vertical and rotary movement therewith within a well bore and having a bowl on its inner side with a downwardly and inwardly helically tapered surface, and a circumferentially expandable and contractible grapple having an outer helically tapered surface which is supported on the bowl for movement between an upper expanded position to fit over the object and a lower contracted position in which teeth on its inner surface grip the object to enable it to be lifted with the string and thus retrieved from the well bore. A seal ring mounted on the inner side of the body at one end of the grapple so as to sealably engage about the object, when it is engaged by the grapple, has an annular, upwardly and inwardly extending lip in position to be deformed into sealing engagement with the object, and thus form a barrier to the circulation of fluid downwardly between the body and object.

In use, the grapple is held against rotation with the body, but is free to move vertically with respect thereto, so that the body may be rotated with the string in a direction to expand the grapple and thus permit it to be gradually lowered over the fish. An upward pull of the string causes the grapple to contract and thus the teeth on the grapple to tightly grip the fish for retrieval with the pipe string. If the fish does not come loose, the string is bumped downwardly to cause the grapple to move upwardly on the bowl, and the string is rotated slowly as it is elevated to release the grapple from the object and permit the tool to be retrieved. The seal ring enables fluid to be circulated downwardly through the string and upwardly through the annulus thereabout to assist in loosening the fish.

As also shown on pages 203 and 204 of the 1996–1997 *Composite Catalog*, in one embodiment of the Bowen tool, the seal ring is mounted on the inner diameter of a control ring supported within the body beneath the grapple which is formed as a basket, and a key on the upper end of the control ring fits closely within aligned slots in the lower end of the grapple and bowl of the body to prevent rotation between them. In another embodiment, the seal ring is mounted on the body above the grapple, and the grapple is formed as a coil whose helically tapered outer surfaces are supported on those of the bowl above a central ring supported by the body beneath the grapple and has a tongue on its upper end which engages one side of a key on the control ring to prevent rotation.

In the case of each of the above described seal rings, the inner side of the lip forms an upward continuation of a tapered surface which is formed at an angle, such as 30°, with respect to the vertical. Thus, there is a resulting void or space beneath the lip which, under high pressure conditions, may wrinkle or fold over, particularly since the lip is not strong enough to maintain an axially aligned position with the object, and thus permit leakage downwardly past the lip. In the case of a modified version of the first embodiment of the seal ring, as shown and described in U.S. Pat. No. 4,369,977, there are two such lips, one above the other, with each having an entry surface beneath it. Although alleged in the patent to overcome the sealing problems of the single lip seal rings, each lip is susceptible to the same problem mentioned above.

Hence, the object of this invention is to provide an overshot tool of the type described having a seal ring of either of the types above described which is so constructed and arranged as to substantially reduce the possibility of leakage downwardly therepast, and, more particularly, to do so without substantially increasing its cost of manufacture.

This and other objects are accomplished, in accordance with preferred embodiments of this invention, by a tool of this type in which the seal ring thereof has an inner cylindrical surface beneath the lip which is of substantially the same diameter as that of the fish to fit closely thereabout. Thus, as a result, there is no void or space beneath the lip, but instead a large area which forms an extended cylindrical "footprint" beneath the lip which not only resists the tendency for the lip to fold over or wrinkle, and thus lose its sealing contact with the fish, but also provides a firm foundation to maintain axial alignment of the ring with the fish.

In the drawings, wherein like reference characters are used throughout to designate like parts:

Figure 1:
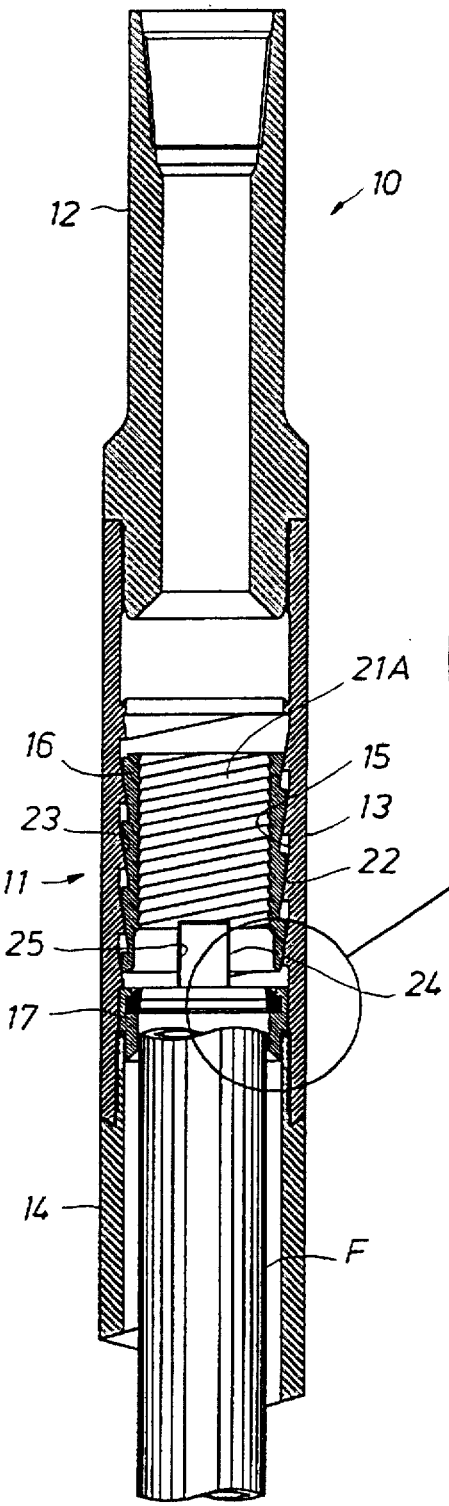
FIG. 1 is a vertical sectional view of the first described embodiment of the overshot tool of the present invention as it is lowered over the upper end of a fish which is stuck in the well bore.
Figure 1A:
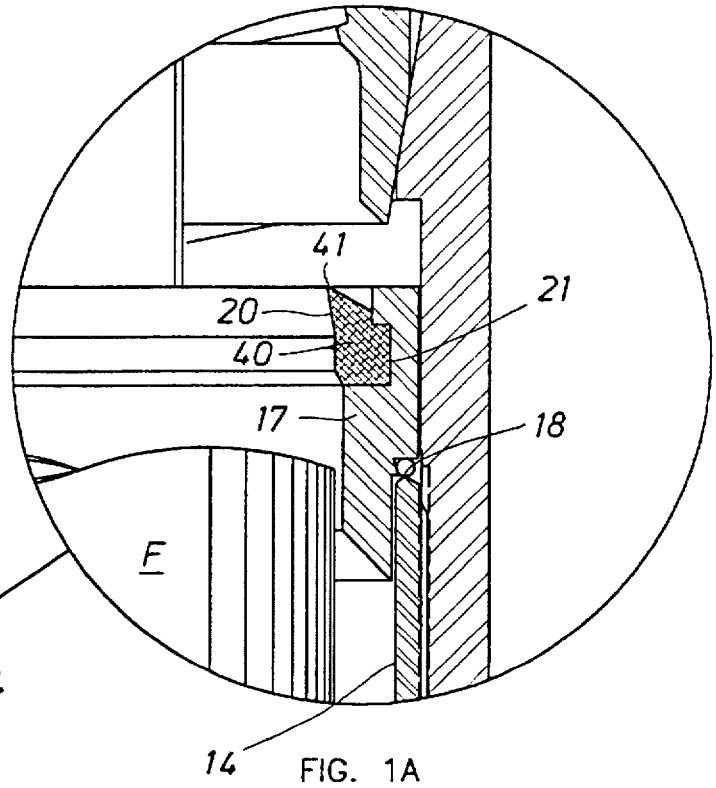
FIG. 1A is an enlarged detailed view of a portion of the upper end of the fish and the seal ring of the tool shown in FIG. 1.
Figures 2, 2A:
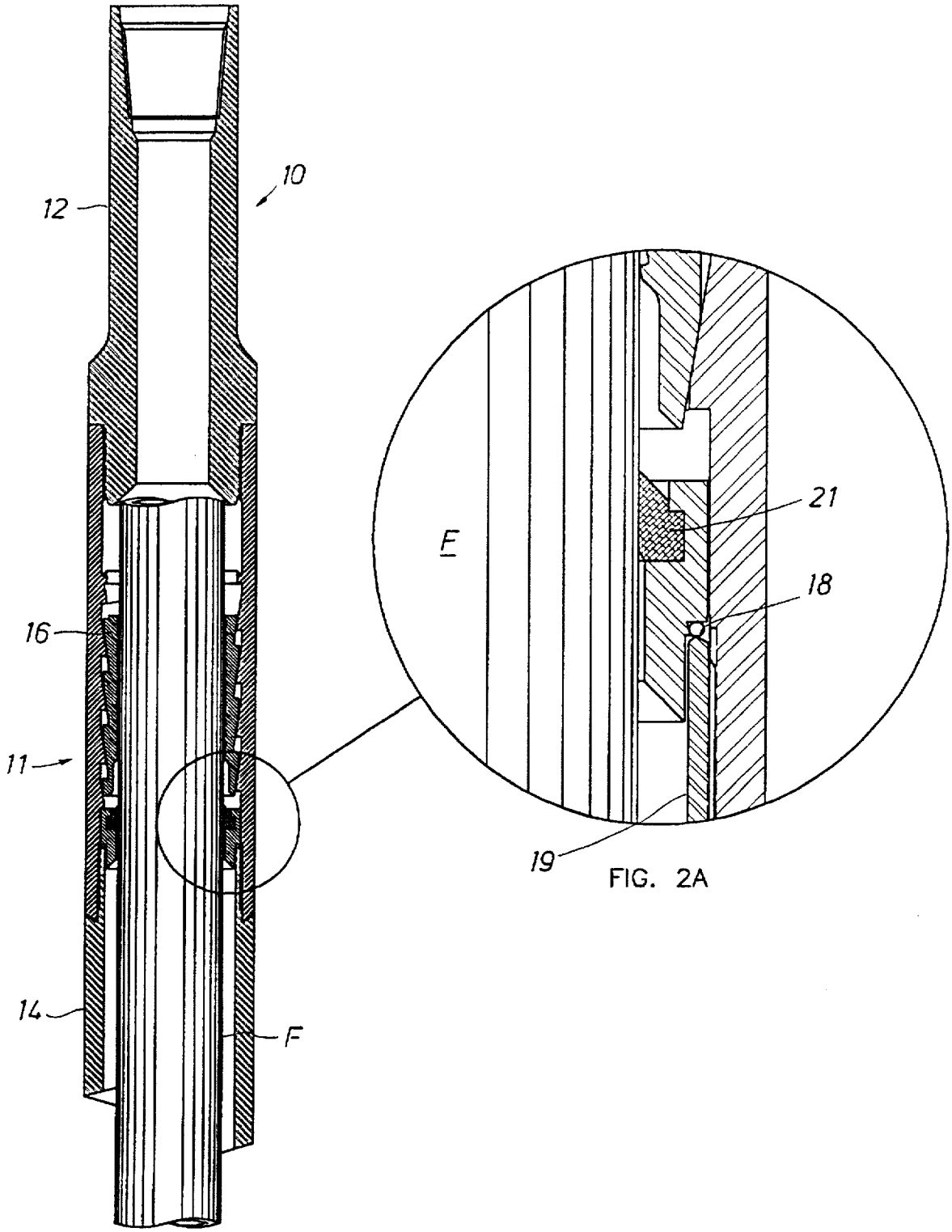
FIG. 2 is a view similar to FIG. 1, but upon further lowering of the tool over the upper end of the fish to cause the grapple thereof to fit over and then engage the fish and the seal ring carried by the tool beneath the grapple to be deformed into sealing engagement with the fish.
FIG. 2A is an enlarged detailed view of the fish and the seal ring of the overshot tool when engaged therewith, as in FIG. 2.
Figure 2B:
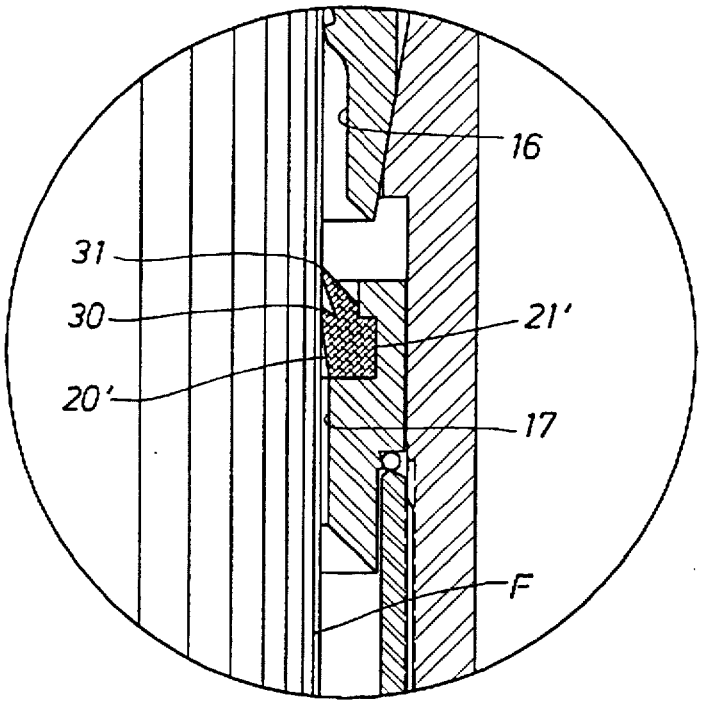
FIG. 2B PRIOR ART
Figure 2B:
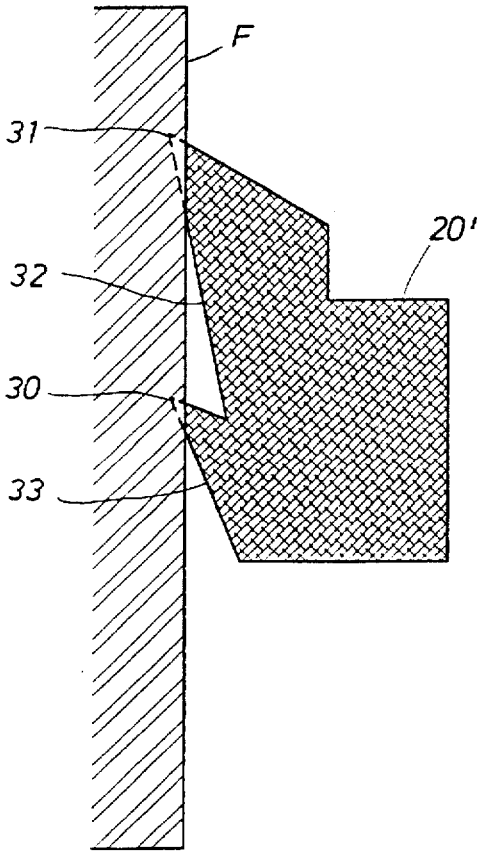
FIG. 2BB PRIOR ART
Figure 2A:
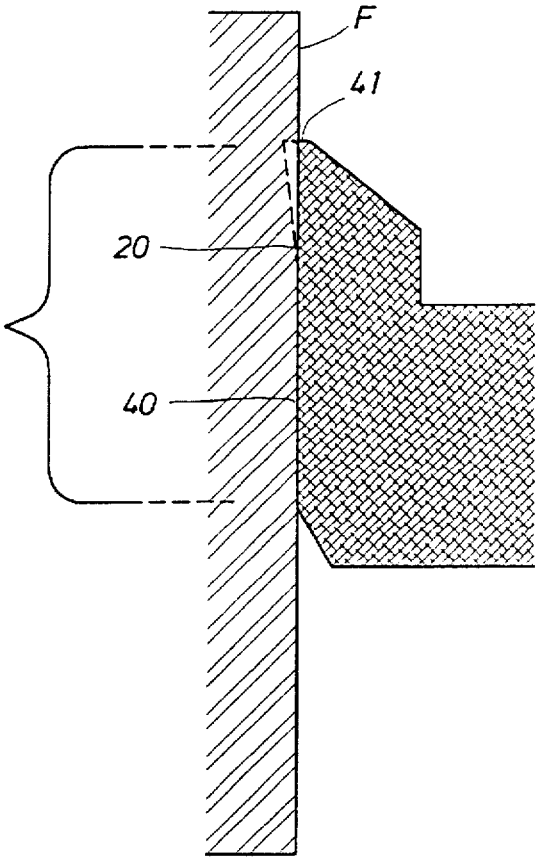
Figure 3:
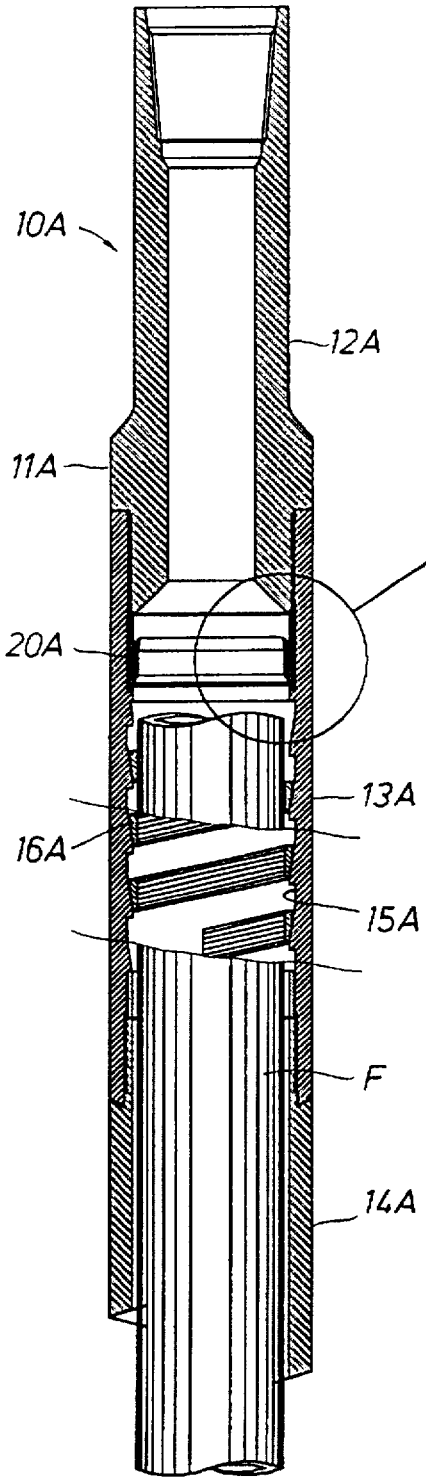
Figure 3A:
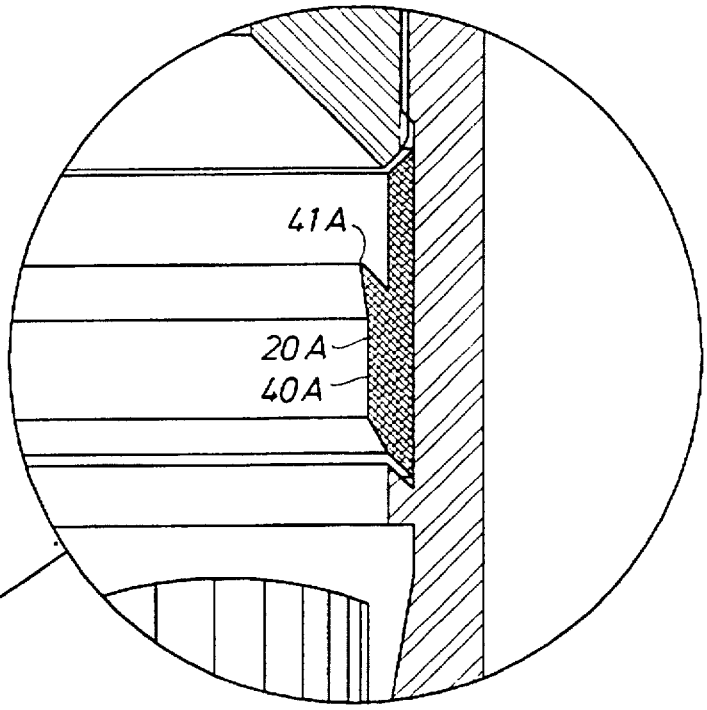
Figure 4:
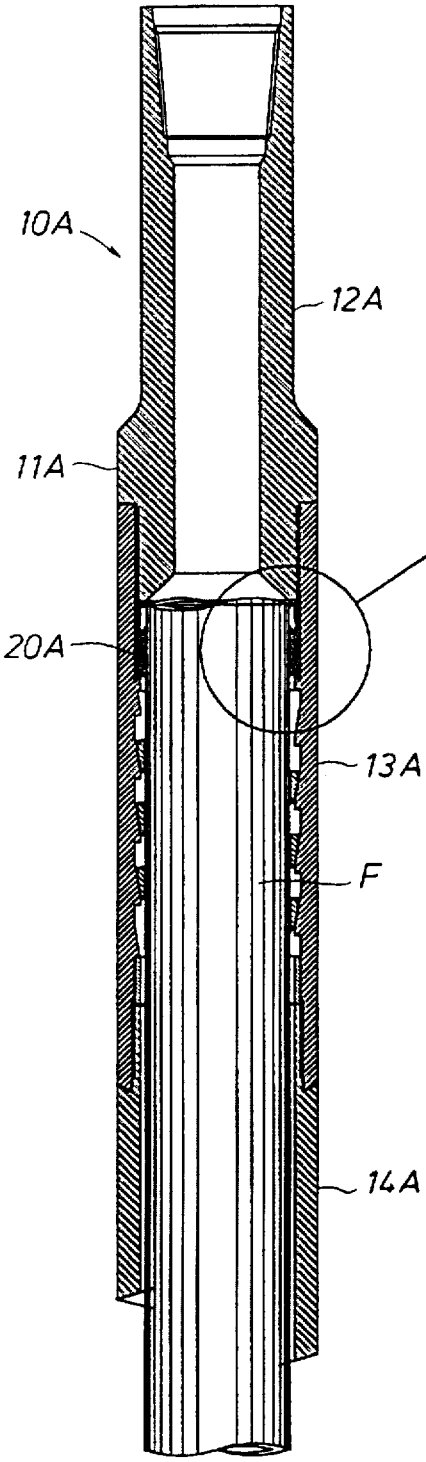
Figure 4A:
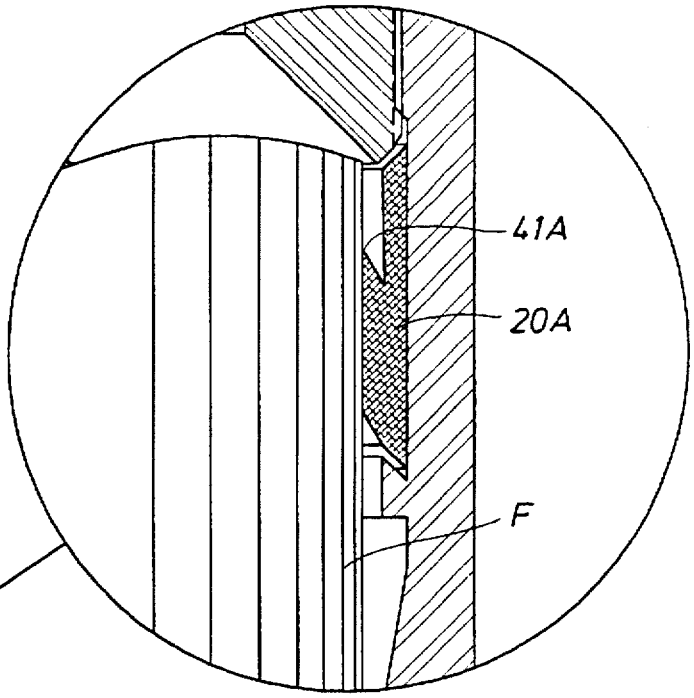
Figure 3B:
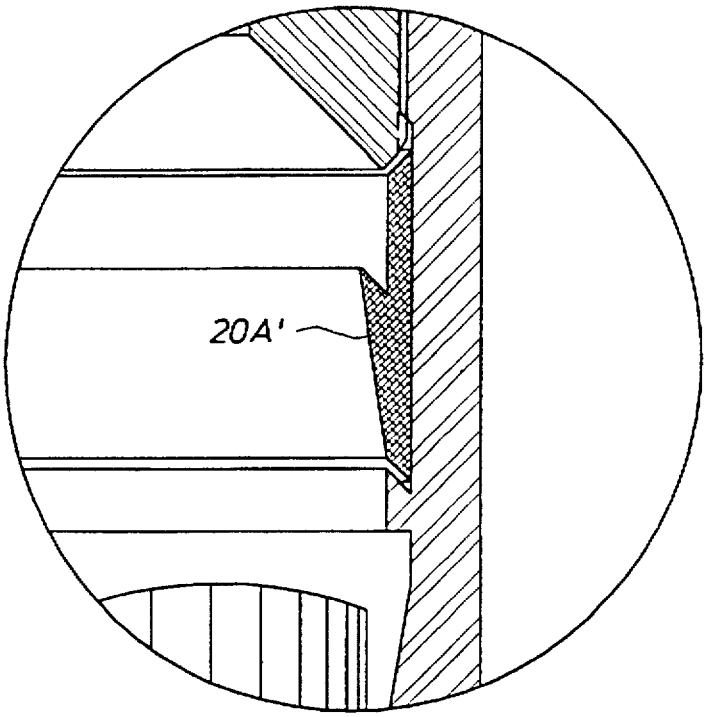
FIG. 3B PRIOR ART
Figure 4B:
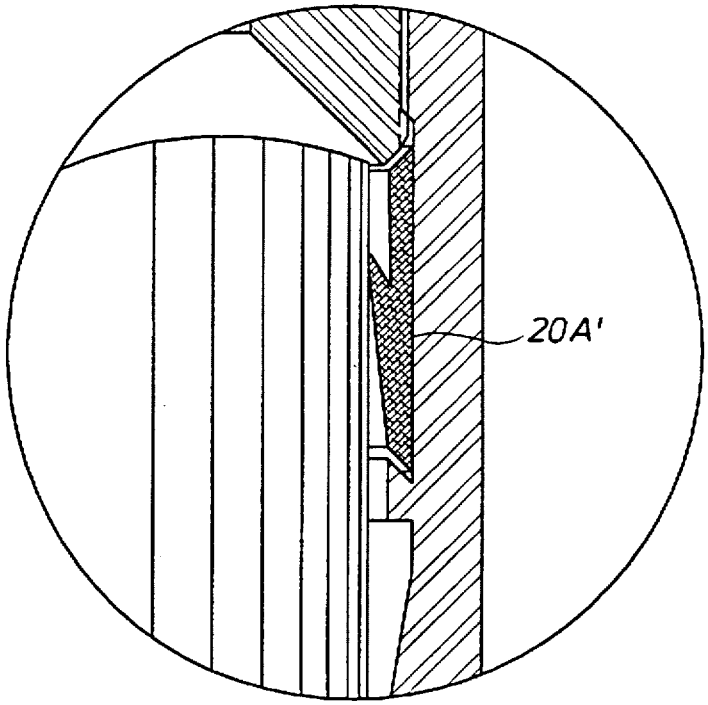
FIG. 4B PRIOR ART
Figure 4B:
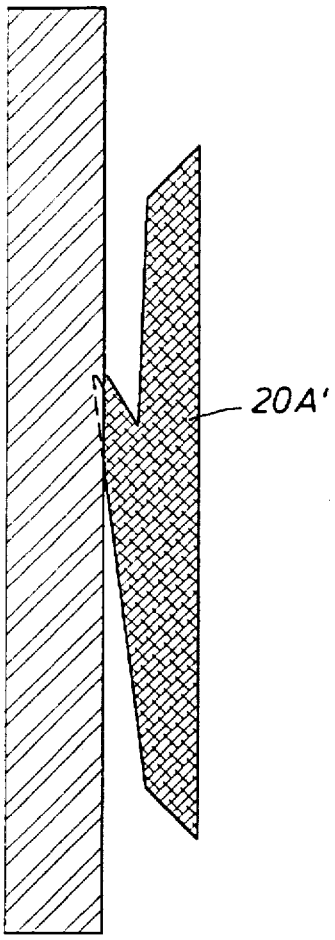
FIG. 4BB PRIOR ART
Figure 4A:
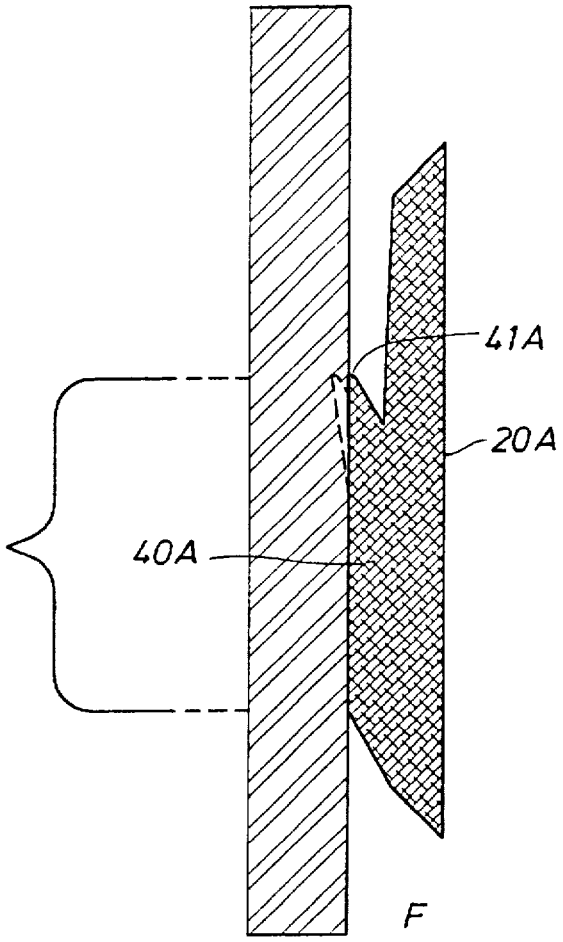

FIGS. 2AA and 2BB are further enlarged views of the overshot tool seal rings of the first embodiment of this invention and the prior art overshot tool, shown respectively in the FIG. 2A and 2B positions, and with a bracket to the side of FIG. 2AA to illustrate the "footprint" of the seal ring of the tool engaged with the fish;

FIG. 3 is a view similar to FIG. 1 of the second described embodiment of the present invention as the lower end of the tool is lowered onto the fish;

FIG. 3A is an enlarged detailed view, similar to FIG. 1A, showing the relative positions of the upper end of the fish and seal ring carried by the tool shown in FIG. 3;

FIG. 3B is a view similar to FIG. 3A of the fish and the seal ring of the second embodiment of the prior art overshot tool as it is first lowered over the fish;

FIG. 4 is a view similar to FIG. 3, but with the second embodiment of the overshot tool of the present invention further lowered on the fish to cause its grapple to grip the fish and its seal ring to sealably engage about the fish;

FIG. 4A is a detailed view of the portion of the fish and seal ring of the overshot tool in the position of FIG. 4;

FIG. 4B is a view similar to FIG. 3B, but upon further lowering of the prior art tool over the fish to cause its seal ring to engage the fish; and FIGS. 4AA and 4BB are further enlarged sectional views of the seal ring of the second embodiment of the overshot tool of this invention and a prior art tool, respectively, showing in greater detail the engagement of the lips of the seal rings thereof with the fish, and by means of a bracket in FIG. 4AA the "footprint" of the seal ring of the second embodiment of the overshot tool engaged with the fish.

With reference now to the details of the above described drawings, the first embodiment of the tool of the present invention, which is shown in its entirety by reference character 10, comprises a body 11 having a sub 12 at its upper end for threaded connection to the lower end of the pipe string, a tubular member 13 connected to the lower end of the sub 12, and a further tubular member 14 connected to the lower end of the tubular member 13 and having a spiraled cutting edge about its lower end. The inner diameter of the tubular member 13 is enlarged to form a recess in the body having a bowl 15 with inwardly and downwardly tapered left hand helical surfaces 23 thereabout, and a grapple 16 is received in the recess and has inwardly and downwardly tapered helical surfaces 22 which conform to surfaces 23 on the bowl.

A ring 17 is supported on an o-ring seated on a shoulder 18 on the upper end of tubular member 14 beneath the lower end of the grapple 16, and a seal ring 20 of elastomeric material has a flange thereabout which is mounted within a groove 21 in the upper end of the ring 17 to dispose it in general alignment with the grapple 16. As will be apparent from the drawings, both the grapple and seal ring are installed within or removed from within the recess for replacement or repair upon removal of the lower tubular member 14.

The inner diameters of the grapple 16 and seal ring 20 are selected to permit them to move over the outer diameter of the fish F which, as previously described and is well known in the art, may be a piece of pipe or another tool, or still another object, stuck within a well bore, as, for example, within a confined space in one side of the well bore. As well known in the art, this normally occurs during the drilling of a well, or perhaps during a remedial operation in an already drilled well, but, in either event, requires that the fish be removed in order to proceed with the drilling or remedial procedures.

As previously described, and as shown in the aforementioned literature illustrating a prior art overshot, the grapple 16 of FIGS. 1 and 2 is in the form of a basket having vertical slits which permit it to be radially expanded and contracted. It normally assumes a contracted position in which the inner diameter is somewhat smaller than the outer diameter of the fish, but is expandable, upon lowering onto the fish, to enable its inner diameter to fit over the fish F. Upon raising of the string, the inwardly and downwardly tapered surfaces 22 about its outer side slide over the inwardly and downwardly tapered surfaces 23 on the bowl 15 to wedge the teeth 21A about the grapple into gripping engagement with the fish so as to permit the fish to be retrieved upon raising of the pipe string.

As previously described, the tapered surfaces 22 and 23 on the grapple and bowl are formed on a continuous left hand spiral, and a tongue 24 carried by the upper end of the ring 17 is closely received within a slot 25 in the lower end of the grapple as well as an aligned slot in the bowl. As a result, the grapple is held for rotation with the bowl through rotation of the body 11, but free to move vertically with respect thereto so that, upon lowering of the tool onto the fish, rotation of the pipe string to the right will cause the grapple to rise with respect to the bowl. Then, the string may be pulled upwardly to force the grapple into tight engagement with the fish.

Figure 1B:
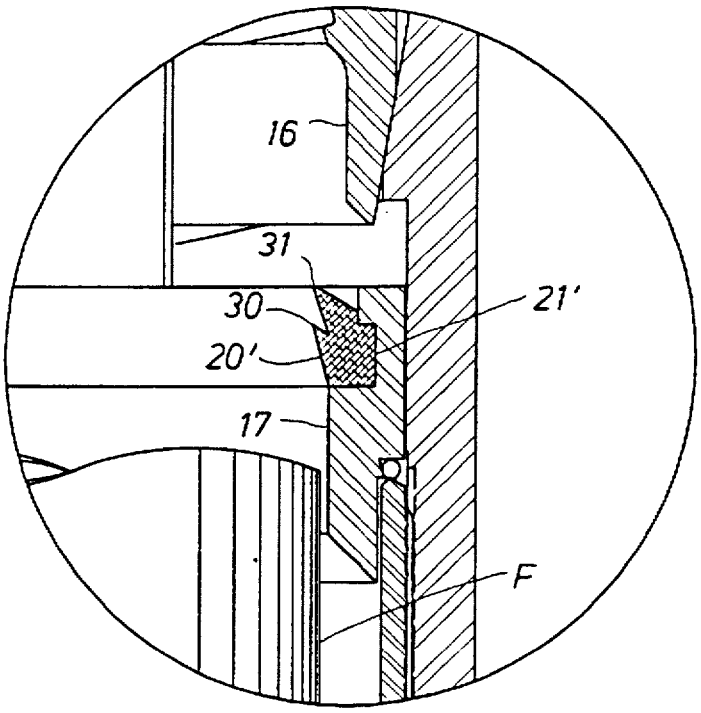
FIG. 1B PRIOR ART
FIG. 1B and 2B are enlarged detailed views of the first embodiment of the prior art tool as its seal ring is lowered over the fish.

The above described tool may be identical to the prior art tool shown and described in the literature mentioned above, except for the construction of the seal ring carried by the control ring 17 for sealably engaging about the fish upon lowering of the tool onto the fish. Thus, in the prior art tool shown in FIGS. 1B and 2B, the seal ring 20' has a flange 21' thereabout for fitting within a groove of the ring 17 beneath the grapple 16. As shown in FIGS. 1A and 1B, however, the seal ring 20' has at least one and preferably a pair of inwardly and upwardly extending seal lips 30 and 31 about its inner diameter. More particularly, and as best shown in FIG. 2BB, the lips are formed on upward continuations of the leadin tapers 32 and 33, respectively, extending inwardly at a relatively small angle with respect to the vertical.

The inner diameters of the lips 30 and 31 are sufficiently smaller than the outer diameter of the fish F as to be flexed or deformed outwardly upon lowering of the tool over the fish, from the broken line positions shown in FIG. 2BB to the solid line positions thereof. In any event, and as previously described, this leaves a generally triangularly shaped annular void or space beneath each lip, and there is only a small portion of the overall seal ring which resists axial misalignment of the seal ring with the fish. This misalignment, combined with the lack of backup for the seal rings, even when there is perfect alignment, may permit the seal rings to curl or bend under due to the high pressure of fluid in the pipe string above the lips.

As previously described, this seal ring permits fluid to be circulated downwardly through the string and tool and upwardly into the annulus in the well bore as to assist in loosening the fish. If the fish cannot be released, however, and it is necessary to retrieve the tool with the string, the tool may be jarred downwardly by the string to permit the grapple to move upwardly on the tapers of the bowl, and the tool body to be rotated to cause the teeth on the grapple to screw off of the fish.

In accordance with the first embodiment of the present invention, however, the seal ring 20 includes a lower cylindrical surface 40 of substantial vertical extent and sized to substantially the same diameter as the outer diameter of the fish, and a lip 41 extending upwardly and inwardly from the upper end of the cylindrical surface in position to be deformed upon lowering of the seal ring over the fish. As best shown in FIG. 2A, the cylindrical surface 40 thus forms a lower continuation of the deformed lip 41 to provide a "footprint" of sealing engagement with the fish for at least a major portion of the vertical extent of the seal ring. This, of course, not only leaves no spaces or voids beneath the lip into which it might be curled or deformed, but also provides substantially more resistance to axial misalignment of the seal ring with respect to the fish.

The second embodiment of the tool of this invention, shown in its entirety by reference character 10A in FIGS. 3 and 4, is similar in many respects to the tool 10 in FIGS. 1 and 2, and hence corresponding parts are designated by the same reference. Thus, the recessed bowl 15A of the body 11A has downwardly and inwardly extending tapered helical surfaces thereabout on which downwardly extending and inwardly extending tapered helical surfaces about the grapple are mounted. As previously described, however, in this second embodiment of the invention, as in the second embodiment of the prior art, the grapple 16A (shown in the broken away section of FIG. 3) is comprised of a coil adapted to expand and contract between a normally assumed position in which it is adapted to seat on the upper end of the fish and an expanded position in which its inner diameter permits it to be lowered over the fish. Thus, the string is rotated to the right to raise the grapple 16A in the bowl and thus permit it to be lowered over the fish, after which the string is raised to cause the tapered outer sides of the coil to move downwardly over the tapers on the bowl to force teeth on the inner side of the grapple into gripping engagement with the fish, whereby the pipe string may be pulled upwardly in an effort to release the fish from its stuck position. As shown in the description of the second embodiment of the prior art tool in the aforementioned literature, the lower end of the grapple has a tongue adapted to engage a side surface on the inside of the body beneath the bowl so as to permit the grapple to be raised and lowered as it is rotated with the pipe.

Seal ring 20A is similar to the second embodiment of the prior art tool, but differs from the seal ring 20 in that it is more elongated and, like the second embodiment of the prior art tool, is mounted within a slot about the body beneath tubular member 12, so that, upon removal of the latter, the seal ring may be installed or removed. It differs from the prior art seal ring in much the same manner as seal ring 20 in that it has an inner cylindrical surface 40A sized substantially to that of the outer diameter of the fish and located on its lower end just beneath an upwardly and inwardly extending lip 41A on an intermediate portion of the ring. In any case, as shown in FIG. 4AA, the lip combines with the cylindrical surface, when sealably engaged with the fish, to form a large "footprint" engaged with the fish. Thus, as in the case of the seal ring of the first embodiment of the invention, the ring 40A does not have a large gap or space between the lower end of its inner diameter and the fish which may be detrimental to the sealing for reasons previously described with respect to the first embodiment of the invention.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As may possible embodiments may be made of the invention without departing from the scope thereof, it is to be understood that all matter herein set forth or shown in the accompanying drawings is to be interpreted as illustrative and not in a limiting sense.

What is claimed is:

1. A tool for use in retrieving an essentially cylindrical object in a well bore, comprising;

a hollow body adapted to be connected to a well string for vertical and rotary movement therewith within the well bore and having a bowl about its inner surface, a circumferentially expandable and contractible grapple having an outer surface supported on an inner surface on the bowl for movement between an upper expanded position to fit over the object to support it therefrom, and a seal ring mounted on the inner side of the bowl at one end of the grapple so as to sealably engage about the object when it is supported by the grapple, said seal ring having an inner cylindrical surface sized to fit closely about the object and an annular, upwardly and inwardly facing lip above the cylindrical surface in position to be deformed into sealing engagement with the object and thus form a barrier to the circulation of fluid downwardly between the bowl and object.

2. As in claim 1, wherein the seal ring is mounted on the body beneath the grapple.

3. As in claim 2, wherein the grapple is a basket slidable over the bowl, and the seal ring is supported on a central ring mounted within the body which holds the grapple and bowl against relative rotation.

4. As in claim 1, wherein the seal ring is mounted on the body above the grapple.

5. As in claim 4, wherein the grapple is a coil slidable over the bowl, and there is a central ring mounted in the body beneath the grapple which holds the grapple and bowl against relative rotation.

* * * * *